United States Patent [19]

Swan et al.

[11] Patent Number: 4,873,015

[45] Date of Patent: Oct. 10, 1989

[54] AZEOTROPE-LIKE COMPOSITIONS OF 1,1,2-TRICHLORO-1,2,2-TRIFLUOROETHANE, METHANOL, NITROMETHANE AND DIMETHOXYMETHANE

[75] Inventors: Ellen L. Swan, Ransomville; Rajat S. Basu, Williamsville; Earl A. E. Lund, West Seneca; David P. Wilson, Williamsville, all of N.Y.

[73] Assignee: Allied-Signal Inc., Morris Township, Morris County, N.J.

[21] Appl. No.: 264,552

[22] Filed: Oct. 31, 1988

[51] Int. Cl.[4] ..... C11D 7/50; C11D 7/30

[52] U.S. Cl. ..... 252/171; 252/162; 252/170; 252/172; 252/364; 252/DIG. 9; 134/12; 134/38; 134/39; 134/40

[58] Field of Search ..... 252/162, 170, 171, 172, 252/364, DIG. 9; 134/12, 38, 39, 40

[56] References Cited

U.S. PATENT DOCUMENTS

| | | | |
|---|---|---|---|
| 2,999,816 | 9/1961 | Bennett et al. | 252/171 |
| 3,573,213 | 3/1971 | Burt | 252/172 |
| 3,960,746 | 6/1976 | Gorski | 252/171 |
| 3,960,746 | 6/1976 | Gorski | 252/171 |
| 4,096,083 | 6/1978 | Clementson | 252/171 |

*Primary Examiner*—Paul Lieberman
*Assistant Examiner*—Kathleen Markowski
*Attorney, Agent, or Firm*—Jay P. Friedenson

[57] ABSTRACT

Azeotrope-like compositions comprising 1,1,2-trichloro-1,2,2-trifluoroethane, methanol, nitromethane and dimethoxymethane are stable and have utility as degreasing agents and as solvents in a variety of industrial cleaning applications including the defluxing of printed circuit boards.

11 Claims, No Drawings

AZEOTROPE-LIKE COMPOSITIONS OF 1,1,2-TRICHLORO-1,2,2-TRIFLUOROETHANE, METHANOL, NITROMETHANE AND DIMETHOXYMETHANE

FIELD OF THE INVENTION

This invention relates to azeotrope-like mixtures of 1,1,2-trichloro-1,2,2-trifluoroethane, methanol, nitromethane and at least 14.5 weight percent dimethoxymethane (also known as methylal). These mixtures are useful as vapor degreasing agents and as solvents in a variety of industrial cleaning applications including defluxing of printed circuit boards.

BACKGROUND OF THE INVENTION

Vapor degreasing and solvent cleaning with fluorocarbon based solvents have found widespread use in industry for the degreasing and otherwise cleaning of solid surfaces, especially intricate parts and difficult to remove soils.

In its simplest form, vapor degreasing or solvent cleaning consists of exposing a room-temperature object to be cleaned to the vapors of a boiling solvent. Vapors condensing on the object provide clean distilled solvent to wash away grease or other contamination. Final evaporation of solvent from the object leaves behind no residue as would be the case where the object is simply washed in liquid solvent.

For difficult to remove soils where elevated temperature is necessary to improve the cleaning action of the solvent, or for large volume assembly line operations where the cleaning of metal parts and assemblies must be done efficiently and quickly, the conventional operation of a vapor degreaser consists of immersing the part to be cleaned in a sump of boiling solvent which removes the bulk of the soil, thereafter immersing the part in a sump containing freshly distilled solvent near room temperature, and finally exposing the part to solvent vapors over the boiling sump which condense on the cleaned part. In addition, the part can also be sprayed with distilled solvent before final rinsing.

Vapor degreasers suitable in the above-described operations are well known in the art. For example, Sherliker et al. in U.S. Pat. No. 3,085,918 disclose such suitable vapor degreasers comprising a boiling sump, a clean sump, a water separator, and other ancillary equipment.

Fluorocarbon solvents, such as trichlorotrifluoroethane, have attained widespread use in recent years as effective, nontoxic, and nonflammable agents useful in degreasing applications and other solvent cleaning applications. Trichlorotrifluoroethane has been found to have satisfactory solvent power for greases, oils, waxes and the like. It has therefore found widespread use for cleaning electric motors, compressors, heavy metal parts, delicate precision metal parts, printed circuit boards, gyroscopes, guidance systems, aerospace and missile hardware, aluminum parts and the like.

The art has looked towards azeotropic compositions including the desired fluorocarbon components such as trichlorotrifluoroethane which include components which contribute additionally desired characteristics, such as polar functionality, increased solvency power, and stabilizers. Azeotropic compositions are desired because they exhibit a minimum boiling point and do not fractionate upon boiling. This is desirable because in the previously described vapor degreasing equipment with which these solvents are employed, redistilled material is generated for final rinse-cleaning. Thus, the vapor degreasing system acts as a still. Unless the solvent composition exhibits a constant boiling point, i.e., is an azeotrope or is azeotrope-like, fractionation will occur and undesirable solvent distribution may act to upset the cleaning and safety of processing. Preferential evaporation of the more volatile components of the solvent mixtures, which would be the case if they were not azeotrope or azeotrope-like, would result in mixtures with changed compositions which may have less desirable properties, such as lower solvency towards soils, less inertness towards metal, plastic or elastomer components, and increased flammability and toxicity.

A number of 1,1,2-trichloro-1,2,2-trifluoroethane based azeotrope compositions have been discovered which have been tested and in some cases employed as solvents for miscellaneous vapor degreasing and defluxing applications. For example, U.S. Pat. No. 3,573,213 discloses the azeotrope of 1,1,2-trichloro-1,2,2-trifluoroethane and nitromethane; U.S. Pat. No. 2,999,816 discloses an azeotropic composition of 1,1,2-trichloro-1,2,2-trifluoroethane and methyl alcohol; U.S. Pat. No. 3,960,746 discloses azeotrope-like compositions of 1,1,2-trichloro-1,2,2-trifluoroethane, methanol and nitromethane. U.S. Pat. No. 4,096,083 discloses azeotrope-like compositions containing 1,1,2-trichloro-1,2,2-trifluoroethane, dimethoxymethane and acetone.

The art is continually seeking new fluorocarbon based azeotropic mixtures or azeotrope-like mixtures which offer alternatives for new and special applications for vapor degreasing and other cleaning applications.

It is accordingly an object of this invention to provide novel azeotrope-like compositions based on 1,1,2-trichloro-1,2,2-trifluoroethane which have good solvency power and other desirable properties for vapor degreasing and other solvent cleaning applications.

Another object of the invention is to provide novel constant boiling or essentially constant boiling solvents which are liquid at room temperature, will not fractionate under conditions of use and also have the foregoing advantages.

A further object is to provide azeotrope-like compositions which are nonflammable both in the liquid phase and the vapor phase. These and other objects and features of the invention will become more evident from the description which follows.

DESCRIPTION OF THE INVENTION

In accordance with the invention, novel azeotrope-like compositions have been discovered comprising 1,1,2-trichloro-1,2,2-trifluoroethane, methanol, nitromethane and dimethoxymethane.

In a preferred embodiment of the invention, the azeotrope-like compositions comprise from about 73.8 to about 80.4 weight percent of 1,1,2-trichloro-1,2,2-trifluoroethane, from about 4.9 to about 5.8 weight percent of methanol, from about 0.02 to about 0.2 weight percent of nitromethane and from about 14.5 to about 20.3 weight percent of dimethoxymethane.

In another preferred embodiment of the invention, the azeotrope-like compositions comprise from about 76.5 to about 80.3 weight percent of 1,1,2-trichloro-1,2,2-trifluoroethane, from about 5.0 to about 5.3 weight percent of methanol, from about 0.02 to about 0.2 weight percent of nitromethane and from about 14.5 to about 18.5 weight percent of dimethoxymethane.

In yet another preferred embodiment of the invention the azeotrope-like compositions comprise from about 79.2 to about 80.3 weight percent of 1,1,2-trichloro-1,2,2-trifluoroethane, from about 5.0 to about 5.3 weight percent of methanol, from about 0.02 to about 0.2 weight percent of nitromethane and from about 14.5 to about 15.2 weight percent of dimethoxymethane.

Such compositions possess constant or essentially constant boiling points of about 39.7° C. at 760 mm Hg. The precise azeotrope composition has not been determined but has been ascertained to be within the above ranges. Regardless of where the true azeotrope lies, all compositions within the indicated ranges, as well as certain compositions outside the indicated ranges, are azeotrope-like, as defined more particularly below.

It has been found that these azeotrope-like compositions are stable, safe to use and that the preferred compositions of the invention are nonflammable (exhibit no flash point when tested by the Tag Open Cup test method-ASTM D 1310-86) and exhibit excellent solvency power. These compositions have been found to be particularly effective when employed in conventional degreasing units for the dissolution of rosin fluxes and the cleaning of such fluxes from printed circuit boards.

From fundamental principles, the thermodynamic state of a system (pure fluid or mixture) is defined by four variables: pressure, temperature, liquid compositions and vapor compositions, or P-T-X-Y, respectively. An azeotrope is a unique characteristic of a system of two or more components where X and Y are equal at the stated P and T. In practice, this means that the components of a mixture cannot be separated during distillation or in vapor phase solvent cleaning when that distillation is carried out at a fixed T (the boiling point of the mixture) and a fixed P (atmospheric pressure).

For the purpose of this discussion, by azeotrope-like composition is intended to mean that the composition behaves like a true azeotrope in terms of its constant boiling characteristics or tendency not to fractionate upon boiling or evaporation. Such composition may or may not be a true azeotrope. Thus, in such compositions, the composition of the vapor formed during boiling or evaporation is identical or substantially identical to the original liquid composition. Hence, during boiling or evaporation, the liquid composition, if it changes at all, changes only to a minimal or negligible extent. This is to be contrasted with non-azeotrope-like compositions in which during boiling or evaporation, the liquid composition changes to a substantial degree.

Thus, in order to determine whether a candidate mixture is "azeotrope-like" within the meaning of this invention, one only has to distill a sample thereof under conditions (i.e. resolution—number of plates) which would be expected to separate the mixture into its separate components. If the mixture is non-azeotropic or non-azeotropic-like, the mixture will fractionate, i.e. separate into its various components with the lowest boiling component distilling off first, and so on. If the mixture is azeotrope-like, some finite amount of a first distillation cut will be obtained which contains all of the mixture components and which is constant boiling or behaves as a single substance. This phenomenon cannot occur if the mixture is not azeotrope-like i.e., it is not part of an azeotropic system. If the degree of fractionation of the candidate mixture is unduly great, then a composition closer to the true azeotrope must be selected to minimize fractionation. Of course, upon distillation of an azeotrope-like composition such as in a vapor degreaser, the true azeotrope will form and tend to concentrate.

It follows from the above that another characteristic of azeotrope-like compositions is that there is a range of compositions containing the same components in varying proportions which are azeotrope-like. All such compositions are intended to be covered by the term azeotrope-like as used herein. As an example, it is well known that at differing pressures, the composition of a given azeotrope will vary at least slightly and changes in distillation pressures also change, at least slightly, the distillation temperatures. Thus, an azeotrope of A and B represents a unique type of relationship but with a variable composition depending on temperature and/or pressure. Accordingly, another way of defining azeotrope-like within the meaning of this invention is to state that such mixtures boil within ±1° C. (at about 760 mm Hg) of the boiling point of the preferred compositions disclosed herein (i.e. closest to the boiling point of the true azeotrope of about 39.7° C. at about 760 mm Hg). The preferred azeotrope-like compositions boil within ±0.6° C. at about 760 mm Hg.

The 1,1,2-trichloro-1,2,2-trifluoroethane, methanol, nitromethane and dimethoxymethane components of the novel solvent azeotrope-like compositions of the invention are all commercially available. Preferably they should be used in sufficiently high purity so as to avoid the introduction of adverse influences upon the solvency properties or constant boiling properties of the system. A suitable grade of 1,1,2-trichloro-1,2,2-trifluoroethane, for example, is sold by Allied-Signal Inc. under the trademark GENESOLV® D.

EXAMPLES 1-2

The azeotrope-like compositions of the invention were determined through the use of distillation techniques designed to provide higher rectification of the distillate than found in most vapor degreaser systems. For this purpose a five theoretical plate Oldershaw distillation column was used with a cold water condensed, automatic liquid dividing head. Typically, approximately 350 cc of liquid were charged to the distillation pot. The liquid was a mixture comprised of various combinations of 1,1,2-trichloro-1,2,2-trifluoroethane, methanol, nitromethane and dimethoxymethane. The mixture was heated at total reflux for about one hour to ensure equilibration. For most of the runs, the distillate was obtained using a 3:1 reflux ratio at a boil-up rate of 250–300 grams per hour. Approximately 120 cc of product were distilled and 4 approximately equivalent sized overhead cuts were collected. The vapor temperature (of the distillate), pot temperature, and barometric pressure were monitored. A constant boiling fraction was collected and analyzed by gas chromatography to determine the weight percentages of its components.

To normalize observed boiling points during different days to 760 mm of mercury pressure, the approximate normal boiling points of 1,1,2-trichloro-1,2,2-trifluoroethane rich mixtures were estimated by applying a barometric correction factor of about 26 mm Hg/°C., to the observed values. However, it is to be noted that this corrected boiling point is generally accurate up to ±0.4° C. and serves only as a rough comparison of boiling points determined on different days. By the above-described method, it was discovered that a constant boiling mixture boiling at ±0.1° C. at 760 mm Hg was formed for compositions comprising about 76.5 to about 80.3 weight percent 1,1,2-trichloro-1,2,2-trifluoroethane (FC-113), about 5.0 to about 5.2 weight percent methanol (MeOH), about 0.05 to about 0.2 weight percent nitromethane, and about 14.5 to about 18.5 weight percent dimethoxymethane. Supporting distillation data for the mixtures studied are shown in Table I.

TABLE I

| Example (Distillation) | Starting Material (wt. %) FC-113 | MeOH | Dimethoxymethane | Nitromethane |
|---|---|---|---|---|
| 1 | 73.8 | 5.8 | 20.3 | 0.2 |
| 2 | 79.8 | 4.9 | 15.1 | 0.3 |

| (Distillation) | Distillate FC-113 | MeOH | Dimethoxymethane | Nitromethane |
|---|---|---|---|---|
| 1 | 76.5 | 5.0 | 18.5 | 0.02 |
| 2 | 80.3 | 5.2 | 14.5 | 0.05 |

| (Distillation) | Boiling Point (°C.) | Barometric Pressure (mm Hg) | Boiling Point Corrected to 760 mm Hg |
|---|---|---|---|
| 1 | 39.5 | 736.9 | 39.8 |
| 2 | 39.2 | 742.0 | 39.5 |
| | | Mean | 39.7° C. ± 0.2 |

From the above examples, it is readily apparent that additional constant boiling or essentially constant boiling mixtures of the same components can readily be identified by any one of ordinary skill in this art by the method described. No attempt was made to fully characterize and define the true azeotrope in the system comprising 1,1,2-trichloro-1,2,2-trifluoroethane, methanol, nitromethane and dimethoxymethane, nor the outer limits of its compositional ranges which are constant boiling. Anyone skilled in the art can readily ascertain other constant boiling or essentially constant boiling mixtures.

EXAMPLE 3

To illustrate the azeotrope-like nature of the mixtures of this invention under conditions of actual use in vapor degreasing operation, a vapor phase degreasing machine was charged with a preferred azeotrope-like mixture in accordance with the invention, comprising about 79.1 weight percent 1,1,2-trichloro-1,2,2-trifluoroethane (FC-113), about 5.1 weight percent methanol, about 15.2 weight percent dimethoxymethane, and about 0.2 weight percent nitromethane. The mixture was evaluated for its constant boiling or non-segregating characteristics. The vapor phase degreasing machine utilized was a small water-cooled, three-sump vapor phase degreaser, which represents a type of system configuration comparable to machine types in the field today which would present the most rigorous test of solvent segregating behavior. Specifically, the degreaser employed to demonstrate the invention contains two overflowing rinse-sumps and a boil-sump. The boil-sump is electrically heated, and contains a low-level shut-off switch. Solvent vapors in the degreaser are condensed on water-cooled stainless-steel coils. The still is fed by gravity from the boil-sump. Condensate from the still is returned to the first rinse-sump, also by gravity. The capacity of the unit is approximately 1.5 gallons. This degreaser is very similar to Baron Blakeslee 2 LLV 3-sump degreasers which are quite commonly used in commercial establishments.

The solvent charge was brought to reflux and the compositions in the rinse sump containing the clear condensate from the still, the work sump containing the overflow from the rinse sump, and the boil sump where the overflow from the work sump is brought to the mixture boiling point were determined with a Perkin Elmer Sigma 3 gas chromatograph. The temperature of the liquid in the boil sump and still was monitored with a thermocouple temperature sensing device accurate to ±0.2° C. Refluxing was continued for 48 hours and sump compositions were monitored throughout this time. If the mixture was not azeotrope-like, the high boiling components would very quickly concentrate in the still and be depleted in the rinse sump. This did not happen. This result indicates that the compositions of this invention will not segregate in any types of large-scale commercial vapor degreasers, thereby avoiding potential safety, performance, and handling problems. The preferred composition tested was also found to not have a flash point according to recommended procedures ASTM D-56 (Tag Closed Cup) and ASTM D-1310 (Tag Open Cup).

What is claimed is:

1. Azeotrope-like compositions consisting essentially of 1,1,2-trichloro-1,2,2-trifluoroethane, methanol, nitromethane and at least about 14.5 weight percent dimethoxymethane wherein said compositions have a boiling point of about 39.7° C. ±1° C. at 760 mm Hg.

2. Azeotrope-like compositions consisting essentially of from about 73.8 to about 80.4 weight percent 1,1,2-trichloro-1,2,2-trifluoroethane, from about 4.9 to about 5.8 weight percent methanol, from about 0.02 to about 0.2 weight percent nitromethane, and from about 14.5 to about 20.3 weight percent dimethoxymethane.

3. Azeotrope-like compositions according to claim 2 wherein said weight percent of 1,1,2-trichloro-1,2,2-trifluoroethane is from about 76.5 to about 80.3, said weight percent of methanol is from about 5.0 to about 5.3, said weight percent of nitromethane is from about 0.02 to about 0.2, said weight percent of dimethoxymethane is from about 14.5 to about 18.5.

4. Azeotrope-like compositions according to claim 2 wherein said weight percent of 1,1,2-trichloro-1,2,2-trifluoroethane is from about 79.2 to about 80.3, said weight percent of methanol is from about 5.0 to about 5.3, said weight percent of nitromethane is from about 0.02 to about 0.2, said weight percent of dimethoxymethane is from about 14.5 to about 15.2.

5. Azeotrope-like compositions according to claim 3 consisting of 1,1,2-trichloro-1,2,2-trifluoroethane, methanol, nitromethane and dimethoxymethane.

6. The method of cleaning a solid surface which comprises treating said surface with an azeotrope-like composition as defined in claim 1.

7. The method of cleaning a solid surface which comprises treating said surface with an azeotrope-like composition as defined in claim 2.

8. The method of cleaning a solid surface which comprises treating said surface with an azeotrope-like composition as defined in claim 3.

9. The method of cleaning a solid surface according to claim 6 in which the solid surface is a printed circuit board contaminated with solder flux.

10. The method of cleaning a solid surface according to claim 7 in which the solid surface is a printed circuit board contaminated with solder flux.

11. The method of cleaning a solid surface according to claim 8 in which the solid surface is a printed circuit board contaminated with solder flux.

* * * * *

UNITED STATES PATENT AND TRADEMARK OFFICE

CERTIFICATE OF CORRECTION

PATENT NO. : 4,873,015

DATED : October 10, 1989

INVENTOR(S) : E. L. Swan et al.

It is certified that error appears in the above-identified patent and that said Letters Patent is hereby corrected as shown below:

In Claim 5, Column 6, line 48 of the Patent, delete "claim 3"; substitute therefor --claim 2--.

Signed and Sealed this

Eighteenth Day of September, 1990

*Attest:*

HARRY F. MANBECK, JR.

*Attesting Officer*

*Commissioner of Patents and Trademarks*